United States Patent [19]

Nitzberg et al.

[11] Patent Number: 4,947,905

[45] Date of Patent: Aug. 14, 1990

[54] FLOW RATE LIMITING DEVICE FOR AN AUTOMATIC SHUT-OFF LIQUID DISPENSING NOZZLE

[76] Inventors: Leonard R. Nitzberg, 1413 Buckeye La., Knoxville, Tenn. 37919; Paul D. Manhardt, 1008 Tokalon Dr., Knoxville, Tenn. 37922

[21] Appl. No.: 40,278

[22] Filed: Apr. 20, 1987

Related U.S. Application Data

[63] Continuation-in-part of Ser. No. 21,399, Mar. 4, 1987.

[51] Int. Cl.[5] ..... B65B 57/04

[52] U.S. Cl. ..... 141/206; 141/209; 141/217; 141/227; 141/392

[58] Field of Search ..... 141/192, 198, 206, 207, 141/208, 209, 210, 211, 212, 213, 214, 215, 216, 217, 218, 219, 220, 221, 222, 223, 224, 225, 226, 227, 228, 229, 392; 137/117, 499, 504; 239/63, 570–572; 251/16; 138/504; 222/547

[56] References Cited

U.S. PATENT DOCUMENTS

| | | | |
|---|---|---|---|
| 2,841,191 | 7/1958 | Fraser | 141/209 |
| 2,851,065 | 9/1958 | Klikunas et al. | 141/209 |
| 2,874,735 | 2/1959 | Boone | 141/208 |
| 2,934,103 | 4/1960 | Frise | 141/208 |
| 2,981,299 | 4/1961 | Henry | 141/209 |
| 3,101,101 | 8/1963 | Gearhart et al. | 141/224 |
| 3,521,681 | 7/1970 | Wilson | 141/209 |
| 4,059,135 | 11/1977 | Hansel | 141/207 |
| 4,121,635 | 10/1978 | Hansel | 141/207 |
| 4,223,699 | 9/1980 | Wilder et al. | 141/206 X |

*Primary Examiner*—Henry J. Recla
*Assistant Examiner*—Edward Donova
*Attorney, Agent, or Firm*—Alan Ruderman

[57] ABSTRACT

An automatic shut-off fuel dispensing nozzle (10) with a flow rate limiting mechanism (90). The nozzle (10) includes a valve (24) which controls the flow of fuel through a passage (16) leading from the nozzle inlet (12) to the nozzle outlet (20) which is normally connected to a spout. This valve (24) is responsive to a manually operable lever and to a vacuum operated release mechanism (26) which automatically shuts the flow of fuel through the nozzle off when the level of fuel in a tank reaches a preselected level or when the flow of fuel through the nozzle reaches a preselected threshold rate of flow.

4 Claims, 2 Drawing Sheets

FLOW RATE LIMITING DEVICE FOR AN AUTOMATIC SHUT-OFF LIQUID DISPENSING NOZZLE

This application is a Continuation-In-Part of United States patent application Ser. No. 021,399, filed Mar. 4, 1987.

Technical Field

This invention relates to fuel dispensing nozzles, and more particularly concerns a device for limiting the rate of flow of fuel through an automatic shut-off fuel dispensing nozzle, such that it is prevented from exceeding a preselected threshold flow rate.

Background Art

Liquid and fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds a liquid such as pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations. Moreover, automatic shut-off nozzles serve to automatically close the flow valve when the level of the liquid in the tank (or a neck leading thereto) being filled reached a preselected level. This is normally accomplished by actuation of a vacuum operated release mechanism mechanically coupled with the flow valve.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been passed which are designed to limit the rate of flow of fuel through the dispensing nozzle. By limiting the rate of flow, the amount of fumes escaping can be reduced to a level which is less likely to cause significant damage to the earth's atmosphere.

Accordingly, it is an object of the present invention to provide a flow rate limiting device and method for an automatic shut-off fuel dispensing nozzle and which serves to limit the rate of flow of fuel through the nozzle.

It is another object of the present invention to provide a flow rate limiting device and method which can be readily installed in existing automatic shut-off dispensing nozzles to place them in compliance with government regulations.

It is also an object of the invention to provide a flow rate limiting device which can be readily manufactured and easily maintained.

Disclosure of the Invention

Other objects and advantages will be obvious to those skilled in the art, and will in part appear hereinafter and be accomplished by the present invention which provides an automatic shut-off fuel dispensing nozzle with a flow rate limiting device. The nozzle includes an inlet through which a liquid such as fuel is supplied to the nozzle from a supply hose and an outlet. An internal flow passage provides fluid communication and a path along which fuel flows between said inlet and said outlet. A spout communicates with the outlet and is capable of being inserted into a tank through an opening therein or into a neck leading to the tank for dispensing fuel. A valve is mounted in the nozzle body and controls the flow of liquid through the passage. The opening and closing of the valve is accomplished manually as by a lever. A vacuum generating device is positioned proximate the flow passage and develops a vacuum of a magnitude proportionate to the rate of flow of liquid in the nozzle. This vacuum generating device is mounted in fluid communication with a vacuum operated release mechanism which releases the manually operated lever to close the valve and shut off the liquid flow through the nozzle when the vacuum magnitude reaches a preselected threshold level. The operation of the release means is controlled by a vacuum relief system which prevents the vacuum developed proximate the release mechanism from reaching a triggering magnitude unless one of the following conditions occurs: (1) the fuel in the tank rises to a level which constricts a vacuum relief opening at the external surface of the spout; (2) the relief opening at the external surface of the spout is restricted due to air turbulence created in the neck of the tank by displacing air with fuel during the filling operation; or (3) the flow rate of fuel through the nozzle creates a vacuum of such magnitude that the relief mechanism is unable to provide adequate relief thereof and thus a vacuum is generated proximate the release mechanism which has a magnitude sufficient to trigger the release mechanism and automatically shut off the fuel flow to the nozzle.

BRIEF DESCRIPTION OF DRAWINGS

The above mentioned features of the present invention will be more clearly understood by consideration of the following detailed description in connection with the accompanying drawing in which.

BEST MODE FOR CARRYING OUT THE INVENTION

Figures 1, 2:
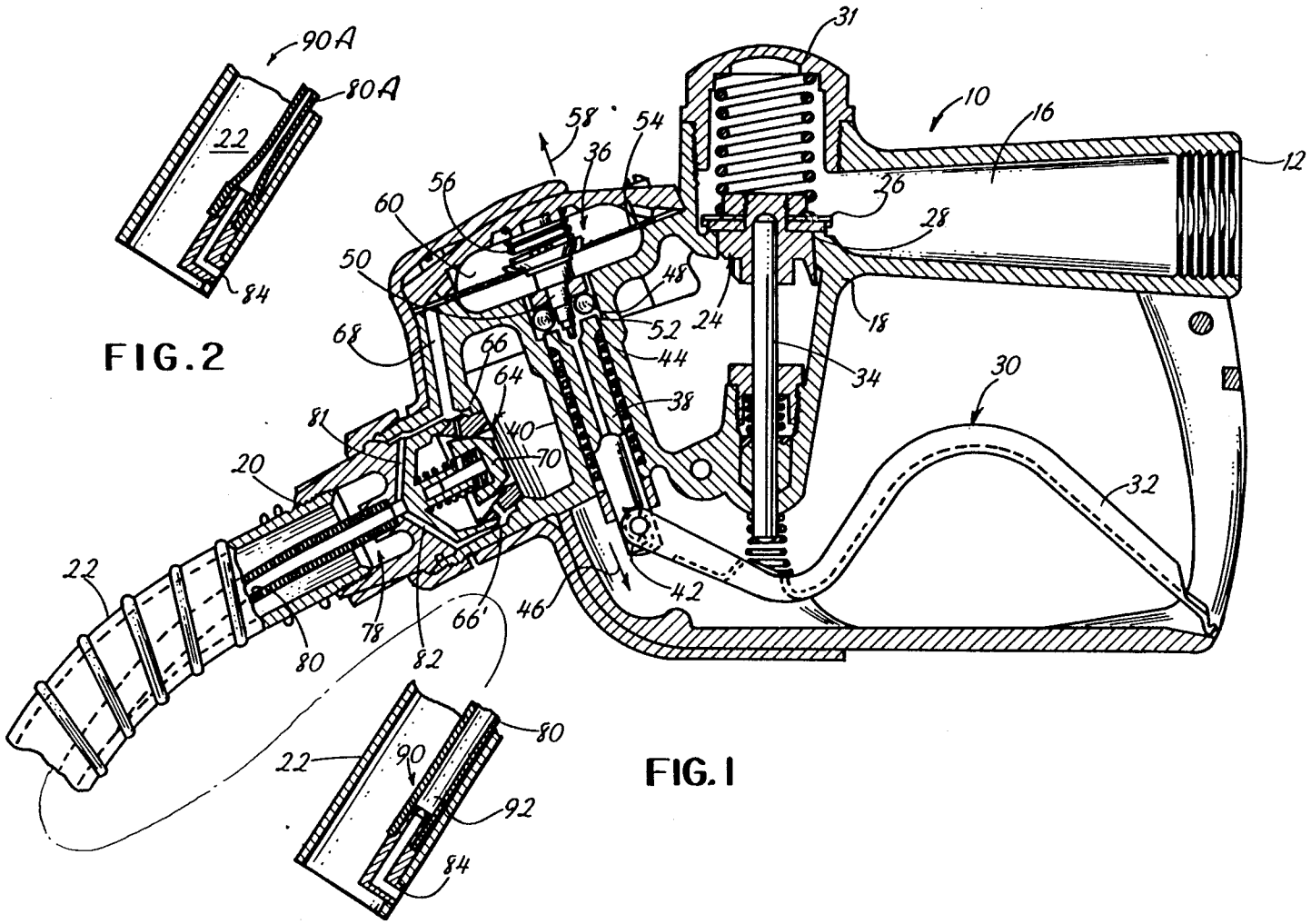
FIG. 1 is a sectional side elevation view of an automatic shut-off dispensing nozzle constructed in accordance with various features of the present invention.
FIG. 2 is a sectional view of a flow rate limiting device wherein vacuum relief is limited by a relief tube having an orifice of a predetermined size.

Referring now to the drawings, an automatic shut-off fuel dispensing nozzle constructed in accordance with various features of the present invention is illustrated generally at 10 in FIG. 1. This nozzle includes an inlet 12 which is mounted in fluid communication with a suitable supply hose (not shown) or the like which supplies pressurized liquid or fuel such as gasoline to the nozzle 10. This fuel is pressurized by the action of a pump mounted at a remote location from the nozzle 10. The fuel flows from the hose through a conventional attachment means or coupling into the inlet 12 of the nozzle and enters the internal flow passage 16. This passage 16 extends through the body 18 of the nozzle 10. The internal flow passage 16 terminates at the outlet 20 which normally comprises, or is connected in fluid communication to, a spout 22 through which fuel is dispensed into the fuel tank of a motorized vehicle or the like.

The flow of fuel through the internal flow passage 16 is controlled in an automatic shut-off nozzle such as shown in FIG. 1 by a valve 24. This valve 24 is mounted such that when the valve member 26 rests on the valve seat 28 the flow of liquid through the internal flow passage 16 is prohibited. Upon manual operation of the valve control or lever 30, the valve member 26 is moved against the biasing force of the spring 31 thus opening the internal flow passage 16 such that the pressurized fuel can flow therethrough. When the manual control lever 30 is released, the spring 31 biases the valve member 26 towards the seat 28 and thus closes the internal flow passage and terminates the flow of fuel therethrough. More specifically, it will be noted in FIG. 1 that the manual control lever 30 comprises a valve lever 32 which engages the rod 34 for moving the valve member 26 away from the valve seat 28 to allow fuel to flow through the internal flow passage which terminates in the spout 22.

An important feature of an automatic shut-off nozzle of conventional design (such as is shown in U.S. Pat. No. 3,653,415 incorporated by reference) is to provide a mechanism for automatically terminating the flow of liquid through the nozzle when the fuel or liquid in the tank (or neck leading thereto) being filled reaches a preselected level which causes constriction of an opening on the spout. To this end, a vacuum operated release means is provided generally at 36. The illustrated vacuum operated release means 36 comprises a plunger 38 which is slidably mounted in the body portion 40 of the nozzle body 10. This plunger is pivotally connected at its outward end portion 42 to the lever 32. Spring 44 serves to bias the plunger 38 in the direction of the arrow 46. The plunger 38 is held in the position shown in FIG. 1 by a detent mechanism 48. The detent mechanism of conventional design comprises a plurality of balls, shown in FIG. 1, which are forced outwardly in a radial direction from the longitudinal axis of the plunger 38 by member 50. It will be noted that these balls comprising the detent member 48 engage the shoulder 52 of the bore in the nozzle body 18 which receives the plunger 38 such that this plunger 38 can not move in the direction of the arrow 46 when the balls are forced radially outwardly by the member 50. This member 50 is connected to a diaphram 54 which is spring biased by the spring 56 in the direction of the arrow 46. When the diaphram is pulled upwardly in the direction of the arrow 58 the member 50 is removed from the location between the detent mechanism or balls 48 and allows the plunger, under the biasing force of this spring 44 to move in the direction of the arrow 46. This releases the mechanical connection between the lever 32 and the rod 34 and automatically causes the valve 24 to close. Thus, the negative pressure or vacuum generated in the chamber 60 above the diaphram 54 serves to control the automatic shut-off operation of the valve 24 to terminate the flow of liquid through the passage 16.

The vacuum which serves to trigger the vacuum operated release mechanism 36 is generated by a venturi vacuum generating mechanism 64 shown in FIG. 1. This venturi vacuum generating mechanism 64 is of substantially conventional design and is positioned in the passage 16 extending between the inlet 12 and the outlet 20. More specifically, the mechanism 64 defines at least one venturi port 66 (another port 66' is shown in FIG. 1) past which liquid flows under pressure. A venturi vacuum is generated in these venturi ports which are positioned in fluid communication with the chamber 60 above the diaphram 54 through the connected conduits on ports 82, 81 and 68 as shown in FIG. 1. Thus, the negative pressure or vacuum generated in the venturi ports 66 and 66' communicate with the chamber 60 and serves to pull the diaphram 54 in the direction of the arrow 58. As shown in FIG. 1, a spring biased check valve 70 is positioned proximate the venturi openings 66 and 66' to enhance the development of the negative pressure generated by the venturi vacuum generating means 64. It will be noted that this check valve 70 is moved in a direction down stream as fuel flows through the nozzle to allow ready flow of the fuel past the ports 66 and 66'.

The vacuum generated by the flow of fuel past the venturi ports 66 and 66' is normally relieved by a vacuum relief means generally indicated at 78 in FIG. 1. This vacuum relief means 78 serves to relieve the vacuum generated by the venturi vacuum generating means 64 and in this connection, includes a conduit 80 which is mounted in fluid communication with conduit 81 and 82 which connect the vacuum relief ports to conduit 68. Conduit 80 extends along a portion of the length of the spout 22 as shown in FIG. 1 and terminates at an opening 84 on the surface of the spout 22. The location of this opening 84 is such that it is normally positioned in the tank, or a conduit leading to the tank, which is filled during dispensing operations. As shown in FIG. 1, the opening provides fluid communication between the ambient atmosphere and the vacuum release mechanism 66, or more specifically, the chamber 60 above the diaphram 54.

Thus, vacuum generated by the venturi vacuum generating mechanism 64, which is proportionate to the rate of flow past this means 64, is relieved through the opening 84 such that the release mechanism 36 is not actuated during normal dispensing operations. In the event the opening 84 is constricted as by the level of liquid in the tank rising above the opening 84, the magnitude of the vacuum generated in the chamber 60 reaches a level which serves to move the detent 50 in the direction of the arrow 58 and thereby causing an automatic shut-off of the flow of fuel through the passage 16 as is been described above.

An important feature of the present invention is to provide a flow rate limiting mechanism generally indicated at 90 in FIG. 1 which serves as a triggering device to operate the vacuum operated release mechanism 36 for shutting off the flow of liquid through the nozzle when the flow rate of the liquid reaches a preselected threshold flow rate. To this end the flow rate limiting mechanism generally indicated at 90 in FIG. 1 includes a member 92 which serves as a restricted orifice for limiting the flow of the air which serves to relieve the vacuum generated by the means 64. It will be recognized by those skilled in the art that the size and shape of the orifice defined by the member 92, and of the member 92, can vary. In the preferred embodiment, this orifice will be designed such that the relief means 78 will become ineffective (inadequate to provide relief for the vacuum developed in chamber 60) thereby causing actuation of the vacuum operated release mechanism 36 in the event the flow of fuel past the venturi vacuum generating mechanism 64 reaches a preselected flow rate (such as ten gallons per minute as is presently required by government regulations).

Alternate embodiments of flow rate limiting mechanisms which serve as triggering devices to operate the vacuum operated release mechanism 36 are shown in FIGS. 2–7 which will be described in turn. It will be noted in each of these Figures, the triggering devices 90 A–H are each mounted in the spout 22 at a location such that the devices can interrupt the flow of air through the conduit 80 which, serves as a portion of the vacuum relief system and, provides fluid communication with the external surface of the spout 22 through the opening 84. It will also be noted in FIGS. 4–7 that the particular shape of the conduit 80 can vary in order to accommodate the configuration of, and provide fluid communication with, the flow rate limiting mechanisms 90 A–F.

Referring now to FIG. 2, the flow rate limiting mechanism 90A is the conduit 80A which is, by design, of sufficiently small diameter and of such length as to restrict the flow of air through the relief means 78. This prohibits the relief means 78 from providing proper relief for the vacuum developed in the chamber 60 in the event the flow of fuel past the venturi vacuum generating mechanism 64 reaches a preselected flow rate.

Figure 3:
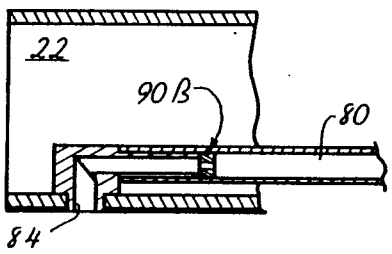
FIG. 3 illustrates a sectional view of a flow rate limiting device which constricts the magnitude of the air flow capable of relieving the vacuum generated by the venturi vacuum generating device.

Referring now to FIG. 3, the flow rate limiting mechanism 90B is of substantially cylindrical configuration and defines an orifice therethrough having a substantially circular cross-sectional outline. The shape of the orifice defined in the mechanism 90B is designed to trigger the vacuum operated release mechanism 36 by restricting the flow of air through the relief means or system 78 such that the mechanism 36 is triggered when the flow of fuel through the passage 16 reaches a preselected threshold rate.

Figure 4:
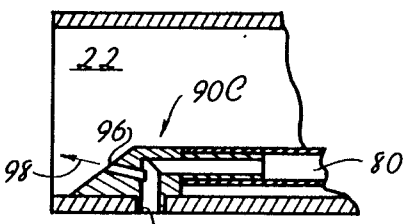
FIG. 4 illustrates an alternate embodiment of a flow rate limiting device employing a counter-acting venturi vacuum generating mechanism.

The embodiment shown in FIG. 4 incorporates a venturi port 96 which serves to counteract the flow of air through the release system 78 and more specifically the conduit 80. This relief port 96 is responsive to the flow of liquid through the spout 22. When this flow rate reaches a preselected threshold rate, the negative pressure drawn through the venturi port 96 in the direction of the arrow 98 limits the rate of flow of air through the relief system 78. Thus, after the flow rate through the spout 22 reaches a preselected rate the vacuum operated release mechanism 36 will be actuated as is described in greater detail hereinabove.

Figure 7:
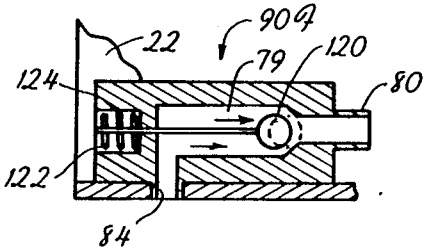
FIG. 7 illustrates an alternate embodiment of a flow rate limiting device having a valve which restricts the flow of air through the vacuum relief system and responds to the rate or magnitude of such flow.
Figure 6:
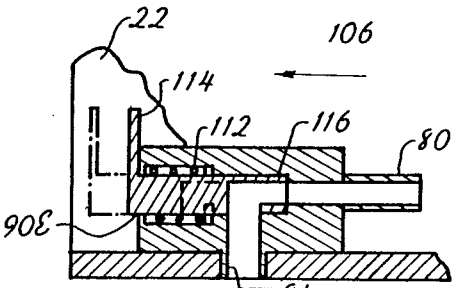
FIGS. 5–6 disclose different embodiments of valve mechanisms which selectively restrict the flow of air through the vacuum relief system.
Figure 5:
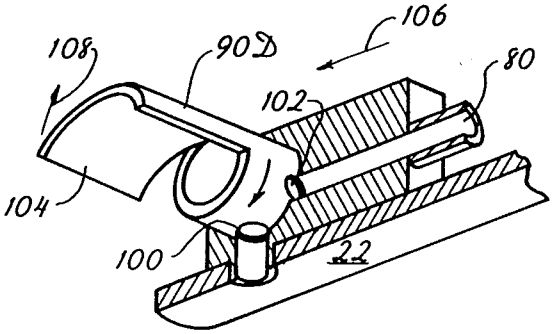

FIGS. 5–7 disclose various embodiments of devices for limiting the flow of air through the vacuum release system 78 or more specifically the conduit 80 in response to valves which are actuated by the flow. In FIGS. 5, 6 the valves are actuated by the flow of liquid through the spout 22. In FIG. 7 the valve is actuated by the flow of air through the flow passage 79 of the relief means 78.

FIG. 5 illustrates a flow rate limiting mechanism 90D which allows the flow of air through the opening 84 and through the conduit 80 when the valve openings 100 and 102 register with the opening 84 and the conduit 80 as is shown in FIG. 5. The flow of liquid through the spout 22 acts upon the air foil portion 103 of valve member 104 which extends into the spout 22. This causes the mechanism 90D to rotate for selectively opening and closing the passage or flow of air through the conduit 80. This member 90D is designed such that air flows through the conduit 80 until the flow of liquid in the direction of the arrow 106 exceeds a preselected threshold level at which point lift in the direction of the arrow 108 will cause rotation of the mechanism 90D and blockage of the conduit 80. When flow is terminated, the valve is urged into the open position either by gravity or suitable biasing means such as a spring.

FIG. 6 illustrates an alternate embodiment of a flow rate limiting mechanism responsive to the flow of fuel through the spout 22 in the direction of the arrow 106. Until the flow exceeds a preselected threshold rate, the member or mechanism 90E is spring biased to the position shown in FIG. 6. As the fuel flow acts against member 114, this member moves in the direction of the arrow 106 against the urging of the spring 112 until section 116 of the mechanism 90E blocks the opening through the conduit 80 and terminates the flow of air through the vacuum release system 78 thereby operating the release mechanism 36.

The flow rate limiting mechanism 90F shown in FIG. 7 serves to terminate the flow of relief air through the conduit 80 and is responsive to this flow of air after it reaches a preselected threshold rate proportionate to the threshold rate of flow of fuel through the passage 16. More specifically, this mechanism 90F includes a member 120 which is mounted on a spring 122 connected to the support 124. When the flow of air through the conduit 80 exceeds a preselected threshold level the member 120 moves to the location of the phantom line thereby terminating the flow of fuel through conduit 80.

From the foregoing detailed description, it will be recognized by those skilled in the art that an improved automatic shut-off dispensing nozzle has been provided with a flow rate limiting device. This device is designed to automatically shut-off the flow of fuel or other liquid through the nozzle when a preselected rate of flow has been reached. This automatic shut-off feature incorporates a flow rate limiting mechanism having various embodiments which can be responsive to the flow of fuel through the nozzle and/or responsive to the flow of relief air drawn into the nozzle through a vacuum relief system. Further, the flow rate limiting mechanism can be readily installed and can be easily maintained.

Thus, although there has been described to this point particular embodiments of the present invention of an automatic shut-off fuel dispensing nozzle with a flow rate limiting mechanism, it is not intended that such specific references be considered as limitations upon the scope of this invention except insofar as set forth in the following claims.

We claim:

1. An automatic shut-off fuel dispensing nozzle with a flow rate limiting means, said nozzle comprising:

a body having an inlet through which a liquid such as fuel is supplied to said nozzle and an outlet, and defining an internal flow passage along which said liquid flows from said inlet to said outlet;

a spout communicating with said outlet and capable of being inserted into a tank through an opening therein for dispensing said liquid, said spout being provided with a vacuum relief opening on the exterior of said spout at a location normally positioned within said tank during dispensing operations;

a valve mounted in said body for controlling the flow of liquid through said passage;

a manually operated means controlling the operation of said valve such that liquid flows through said nozzle only when said valve is opened;

venturi vacuum generating means positioned proximate said flow passage for developing a vacuum of magnitude proportionate to the rate of flow of liquid past said vacuum generating means;

a vacuum operated release means mounted in fluid communication with said vacuum generating means and serving to release said manually operated means to close said valve for automatic shut-off of the liquid flow through said nozzle when the vacuum magnitude proximate said release means reaches a preselected threshold level;

vacuum relief means mounted in fluid communication with said vacuum relief opening of said spout, said relief means defining a vacuum relief conduit for providing fluid communication between the ambient atmosphere and said vacuum generating means and said release means, and adapted to automatically operate the vacuum operated release means when the level of liquid being dispensed in said tank constricts said opening of said vacuum relief means whereby the vacuum generated by said vacuum generating means is not relieved and acts against said release means to cause an automatic shut-off of liquid flowing through said passage; and flow rate limiting means for selectively restricting the capacity of said vacuum relief means to relieve said vacuum generated by said venturi vacuum generating means, whereby said vacuum generated by said vacuum generating means is not relieved when the flow rate of said liquid through said nozzle reaches a preselected threshold flow rate such that said release means serves to release said manually operated means to close said valve for automatic shut-off of said liquid flow through said nozzle, said flow rate limiting means including a first member movably mounted in said spout so as to be movable from a first position whereby said conduit is substantially unobstructed by said first member to a second position whereby said first member at least partially occludes said vacuum relieve conduit, and includes a second member operatively associated with said first member and disposed to intercept the flow of said liquid through said spout, whereby said flow of liquid through said spout acting upon said second member moves said first member into said first position whereby said first member at least partially occludes said conduit.

2. The fuel dispensing nozzle of claim 1 wherein said flow rate limiting means further includes biasing means for biasing said first member to said position whereby said conduit is substantially unobstructed by said first member.

3. The fuel dispensing nozzle of claim 2 wherein said biasing means comprises a spring.

4. The fuel dispensing nozzle of claim 1 wherein said first and second members are rotatably mounted in said spout.

* * * * *